US011249419B2

(12) United States Patent
Takagi

(10) Patent No.: US 11,249,419 B2
(45) Date of Patent: Feb. 15, 2022

(54) STRUCTURE BODY OF IMAGE FORMING APPARATUS, IMAGE FORMING APPARATUS

(71) Applicant: KYOCERA Document Solutions Inc., Osaka (JP)

(72) Inventor: Masaru Takagi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/195,453

(22) Filed: Mar. 8, 2021

(65) Prior Publication Data

US 2021/0278781 A1 Sep. 9, 2021

(30) Foreign Application Priority Data

Mar. 9, 2020 (JP) ..... JP2020-039494

(51) Int. Cl.
*G03G 15/00* (2006.01)
*G03G 15/08* (2006.01)

(52) U.S. Cl.
CPC ..... *G03G 15/0865* (2013.01)

(58) Field of Classification Search
CPC ..... G03G 15/00; G03G 15/0865; G03G 15/6514; G03G 21/1619; G03G 21/1633; G03G 21/1647; G03G 2221/169; G03G 2221/1684; B41J 2/435; B41J 3/407; B41J 3/413; B41J 3/435; B41J 29/38
USPC ..... 399/107, 110
See application file for complete search history.

(56) References Cited

U.S. PATENT DOCUMENTS 6,259,872 B1 7/2001 Fukunaga et al.
9,523,958 B2 * 12/2016 Onishi ..... G03G 21/1619

FOREIGN PATENT DOCUMENTS

JP 2000138470 A 5/2000
JP 2010038345 * 2/2010

* cited by examiner

*Primary Examiner* — Hoan H Tran
(74) *Attorney, Agent, or Firm* — Alleman Hall Creasman & Tuttle LLP

(57) ABSTRACT

In a structure body, a lower-layer portion includes four first column portions, a bottom frame portion, and a first partition frame portion, an upper-layer portion includes four second column portions, a top frame portion, and a second partition frame portion. The bottom frame portion is welded to lower end portions of the first column portions. The first partition frame portion is welded to upper end portions of the first column portions. The second column portions are formed to continue to the lower-layer portion and vertically extend on extension lines of the first column portions. The top frame portion is welded to upper end portions of the second column portions. The second partition frame portion is welded to the second column portions at a position between the first partition frame portion and the top frame portion. Each of the first column portions is thicker than each of the second column portions.

5 Claims, 3 Drawing Sheets

STRUCTURE BODY OF IMAGE FORMING APPARATUS, IMAGE FORMING APPARATUS

INCORPORATION BY REFERENCE

This application is based upon and claims the benefit of priority from the corresponding Japanese Patent Application No. 2020-039494 filed on Mar. 9, 2020, the entire contents of which are incorporated herein by reference.

BACKGROUND

The present disclosure relates to a structure body of an image forming apparatus and an image forming apparatus.

There is known an image forming apparatus that includes a sheet feed portion, a print portion, and a developer container, and further includes a structure body that stores and supports the sheet feed portion, the print portion, and the developer container. For example, the structure body is composed of a plurality of square pipes.

In addition, there is known a configuration where the structure body includes a first support structure body and a second support structure body that are independent of each other, and the first support structure body is coupled with an upper part of the second support structure body in a detachable manner by fitting a positioning pin in a positioning hole.

SUMMARY

A structure body of an image forming apparatus according to an aspect of the present disclosure stores and supports a sheet feed portion, a print portion, and a developer container, the print portion configured to form an image on a paper sheet supplied from the sheet feed portion, the developer container configured to supply developer to the print portion. The structure body includes a lower-layer portion and an upper-layer portion. The lower-layer portion is composed of a plurality of square pipes and includes four first column portions, a bottom frame portion, and a first partition frame portion, the four first column portion vertically extending, the bottom frame portion welded to lower end portions of the four first column portions to form a rectangle, the first partition frame portion welded to upper end portions of the four first column portions to form a rectangle. The upper-layer portion is composed of a plurality of square pipes and includes four second column portions, a top frame portion, and a second partition frame portion, the four second column portions formed to continue to the lower-layer portion and vertically extend on extension lines of the four first column portions respectively, the top frame portion welded to upper end portions of the four second column portions to form a rectangle, the second partition frame portion welded to the four second column portions to form a rectangle at a position between the first partition frame portion and the top frame portion. Each of the first column portions is thicker than each of the second column portions. The lower-layer portion forms a first space that stores the sheet feed portion. A portion of the upper-layer portion under the second partition frame portion forms a second space that stores the print portion. A portion of the upper-layer portion above the second partition frame portion forms a third space that stores the developer container.

An image forming apparatus according to another aspect of the present disclosure includes the sheet feed portion, the print portion, the developer container, and the structure body.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following embodiments are examples of specific embodiments of the present disclosure and should not limit the technical scope of the present disclosure.

First Embodiment

Figure 1:
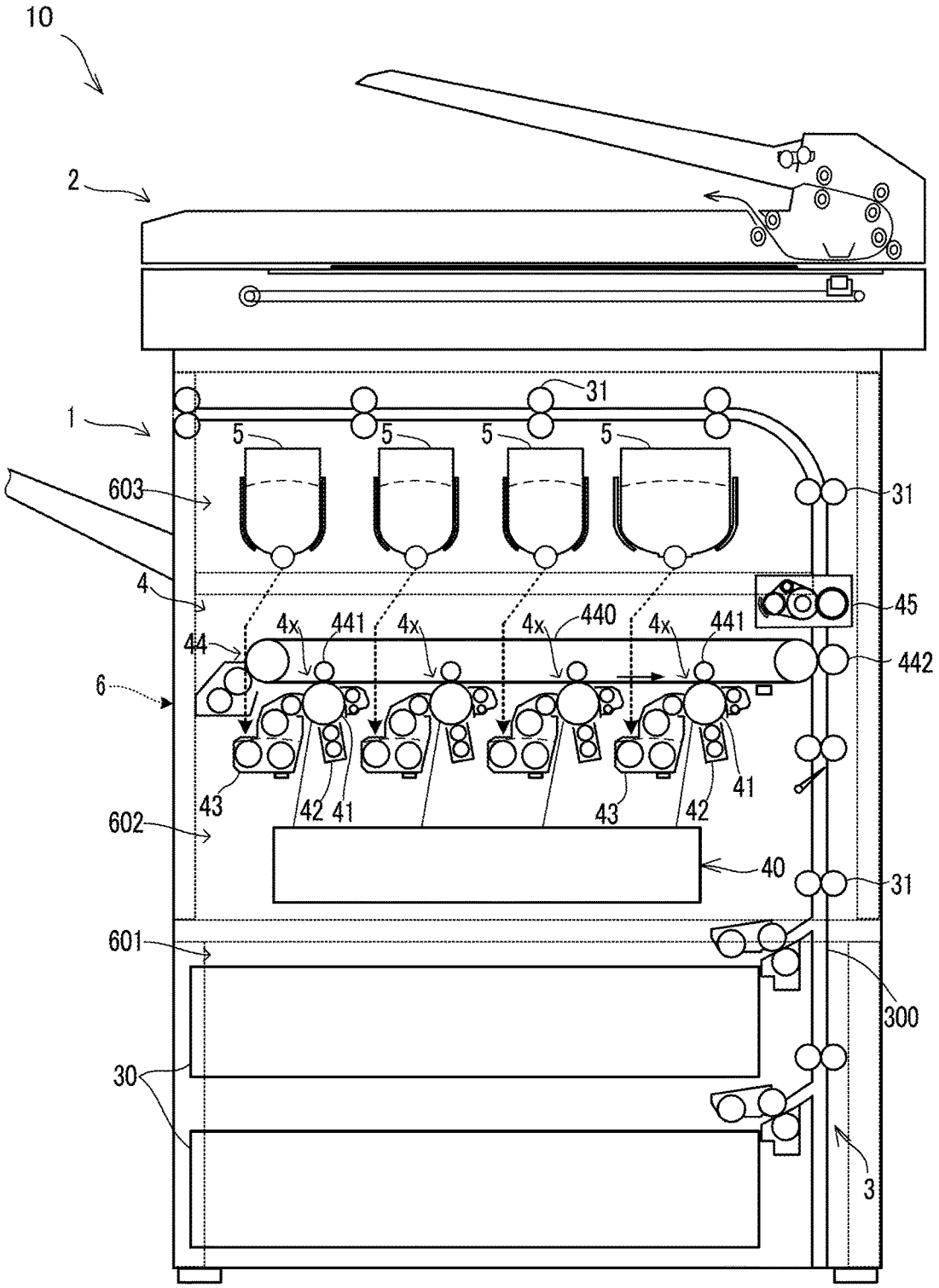
FIG. 1 is a configuration diagram of an image forming apparatus including a structure body according to a first embodiment.

A structure body 6 according to a first embodiment is adopted in an image forming apparatus 10. As shown in FIG. 1, the image forming apparatus 10 includes a main body unit 1 and an image reading unit 2.

The main body unit 1 includes a sheet feed portion 30, a sheet conveying device 3, a print portion 4, one or more developer containers 5, and a structure body 6. The image reading unit 2 is coupled with an upper part of the main body unit 1. The image reading unit 2 is a device configured to read an image from a document sheet.

The sheet feed portion 30 is a device configured to store a plurality of paper sheets and feed the stored paper sheets one by one to a sheet conveyance path 300. The sheet conveying device 3 includes a plurality of pairs of conveyance rollers 31 that convey paper sheets along the sheet conveyance path 300.

The print portion 4 is a device configured to form an image on a paper sheet that is supplied from the sheet feed portion 30 and conveyed thereto by the sheet conveying device 3. In the example shown in FIG. 1, the print portion 4 forms an image on a paper sheet by an electrophotographic method.

The print portion 4 of the electrophotographic method includes a laser scanning unit 40, one or more image creating devices 4*x*, a transfer device 44, and a fixing device 45.

In the example shown in FIG. 1, the print portion 4 is a color image print device of a tandem type. As a result, the print portion 4 includes four image creating devices 4*x* that respectively correspond to four colors of toner. Furthermore, the image forming apparatus 10 includes four developer containers 5 that respectively correspond to the four image creating devices 4*x*.

In each of the image creating devices 4*x*, a drum-like photoconductor 41 rotates, a charging device 42 electrically charges the outer peripheral surface of the photoconductor 41, the laser scanning unit 40 writes an electrostatic latent image on the outer peripheral surface of the photoconductor 41, and the developing device 43 develops the electrostatic latent image as a toner image.

Furthermore, in the transfer device 44: an intermediate transfer belt 440 rotates while in contact with the four photoconductors 41; four primary transfer devices 441 respectively corresponding to the four image creating devices 4*x* transfer the toner images onto the intermediate transfer belt 440; and a secondary transfer device 442 transfers the toner images from the intermediate transfer belt 440 onto a paper sheet that is being conveyed in the sheet conveyance path 300.

The fixing device 45 fixes the toner image on the paper sheet to the paper sheet by heating and pressurizing the toner image. The sheet conveying device 3 discharges the paper sheet on which an image has been formed, from the sheet conveyance path 300.

The developer containers 5 supply toner respectively to the developing devices 43 of the print portion 4. The toner is an example of developer. It is noted that the print portion 4 may be a device configured to form an image on a paper sheet by an inkjet method or another method.

The structure body 6 stores and supports the sheet feed portion 30, the sheet conveying device 3, the print portion 4, and the developer containers 5. The structure body 6 is composed of a combination of a plurality of pipe members 60 (see FIG. 2).

Meanwhile, in a case where the structure body 6 is composed of a plurality of independent element members, it is necessary for each of the element members to have a strength of a predetermined level. For that purpose, the plurality of element members require redundant pipe members 60.

On the other hand, the structure body 6 may be integrally formed by joining a plurality of pipe members 60 by welding. In this case, however, when a drop test of the image forming apparatus 10 is executed, a large impact force is applied to a lower portion of the structure body 6 due to the load of the entire image forming apparatus 10. This may deform the lower portion of the structure body 6.

Figure 2:
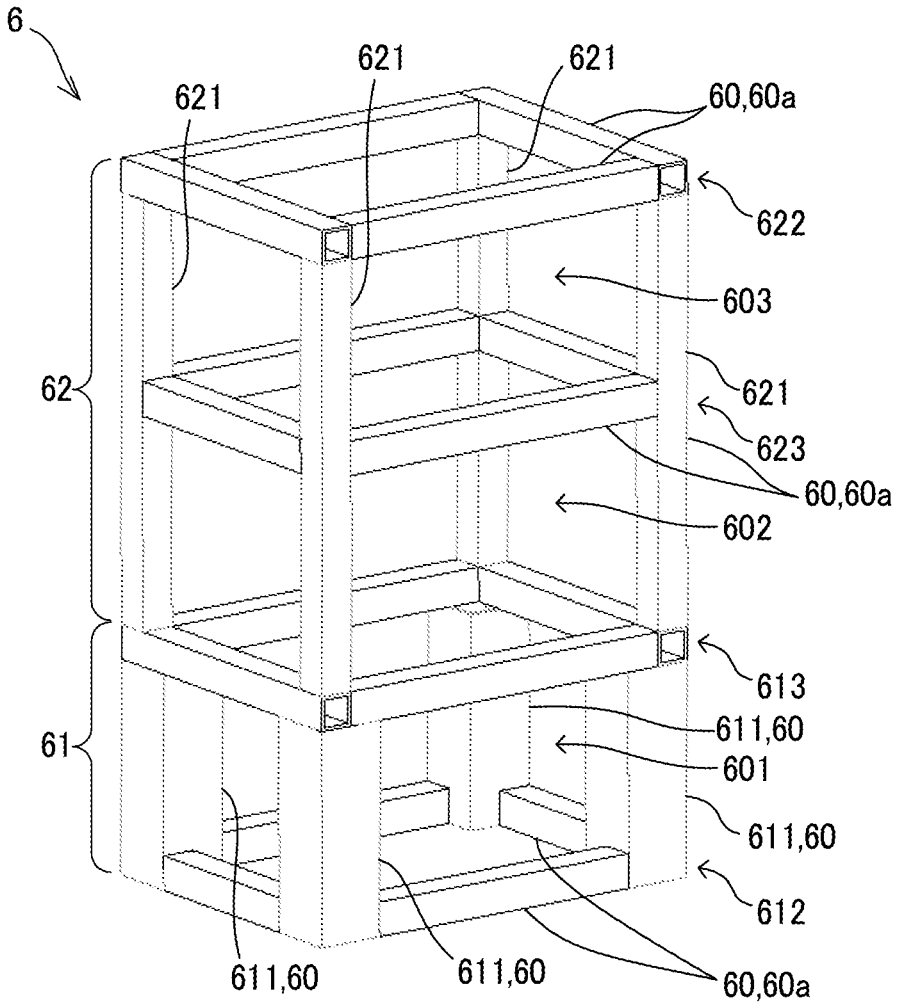
FIG. 2 is a perspective diagram of the structure body according to the first embodiment.

However, the structure body 6 of the present embodiment has a configuration shown in FIG. 2. The structure body 6 does not have redundant pipe members 60, but has a sufficient strength for the drop test.

[Structure Body 6]

The structure body 6 is composed of a plurality of pipe members 60. Each of the pipe members 60 is a square pipe. The structure body 6 is integrally formed by joining the plurality of pipe members 60 by welding.

As shown in FIG. 2, the structure body 6 includes a lower-layer portion 61 and an upper-layer portion 62 each of which is composed of a plurality of pipe members 60. The upper-layer portion 62 is welded to an upper surface of the lower-layer portion 61 in a state where the upper-layer portion 62 is laid on the lower-layer portion 61.

The lower-layer portion 61 includes four first column portions 611, a bottom frame portion 612, and a first partition frame portion 613. The four first column portions 611 are formed to vertically extend at four corners of a rectangle.

In the present embodiment, the plurality of pipe members 60 constituting the structure body 6 include two types of square pipes that have different thicknesses. One of the two types of square pipes is the four first column portions 611, and the other is thin pipes 60*a* that are thinner than the first column portions 611.

That is, the four first column portions 611 are square pipes that are thicker than the other pipe members 60. The whole upper-layer portion 62 and the remaining part of the lower-layer portion 61 other than the four first column portions 611 are composed of the thin pipes 60*a* that have the same thickness.

It is noted that the whole upper-layer portion 62 and the remaining part of the lower-layer portion 61 other than the four first column portions 611 may be composed of a plurality of types of square pipes that are thinner than the first column portions 611 and have different thicknesses.

The bottom frame portion 612 is composed of four pipe members 60 that are welded to lower end portions of the four first column portions 611 to form a rectangle.

In the present embodiment, opposite end portions of each of the four pipe members 60 that constitute the bottom frame portion 612 are welded to sides of the lower end portions of the four first column portions 611. With this configuration, the bottom frame portion 612 and the lower end portions of the four first column portions 611 form a rectangle.

The first partition frame portion 613 is composed of four pipe members 60 that are welded to upper end portions of the four first column portions 611 to form a rectangle. In the present embodiment, one of each of opposite end portions of each of the four pipe members 60 that constitute the first partition frame portion 613 is welded to an upper end surface of one of the four first column portions 611, and the other of each of the opposite end portions of each of the four pipe members 60 is welded to a side of an adjacent one of the four pipe members 60.

The upper-layer portion 62 includes four second column portions 621, a top frame portion 622, and a second partition frame portion 623. The four second column portions 621 are formed to continue to the lower-layer portion 61 and vertically extend on extension lines of the four first column portions 611, respectively.

Each of the first column portions 611 and the second column portions 621 is a square pipe that has no seam in the longitudinal direction thereof. In the present embodiment, lower end portions of the four second column portions 621 are welded to an upper surface of the first partition frame portion 613. Each of the second column portions 621 is thinner than each of the first column portions 611. In other words, each of the first column portions 611 is thicker than each of the second column portions 621.

The top frame portion 622 is welded to upper surface portions of the four second column portions 621 to form a rectangle. The image reading unit 2 is coupled with the top frame portion 622 of the upper-layer portion 62.

In the present embodiment, one of each of opposite end portions of each of four pipe members 60 that constitute the top frame portion 622 is welded to an upper end surface of one of the second column portions 621, and the other of each of the opposite end portions of each of the four pipe members 60 is welded to a side of an adjacent one of the four pipe members 60.

It is noted that opposite end portions of each of four pipe members 60 that constitute the top frame portion 622 may be welded to sides of the upper end portions of the four second column portions 621. In this case, the top frame portion 622 and the upper end portions of the four second column portions 621 form a rectangle.

The second partition frame portion 623 is welded to the four second column portions 621 to form a rectangle, at a position between the first partition frame portion 613 and the top frame portion 622.

Opposite end portions of each of four pipe members 60 that constitute the second partition frame portion 623 are welded to sides of the four second column portions 621. With this configuration, the second partition frame portion 623 and parts of the four second column portions 621 form a rectangle.

The lower-layer portion 61 forms a first space 601 that stores the sheet feed portion 30 and a part of the sheet conveying device 3 (see FIG. 1, FIG. 2). In addition, in the upper-layer portion 62, a portion under the second partition frame portion 623 forms a second space 602 that stores the print portion 4 and another part of the sheet conveying device 3.

In addition, in the upper-layer portion 62, a portion above the second partition frame portion 623 forms a third space 603 that stores the developer containers 5. In the present embodiment, a part of the sheet conveying device 3 is also stored in the third space 603 (see FIG. 1).

With the structure body 6 adopted, redundant pipe members 60 are not required to secure the strength of the element members, whereas the redundant pipe members 60 are required when, for example, independent element members are coupled with each other by a fitting mechanism.

Furthermore, during a drop test of the image forming apparatus 10, even when a large impact force is applied to the lower-layer portion 61 of the structure body 6 due to the load of the entire image forming apparatus 10, the thick four first column portions 611 prevent the lower-layer portion 61 from being deformed.

That is, the structure body 6 does not require redundant pipe members 60, but has a sufficient strength for the drop test.

Second Embodiment

Next, a structure body 6X of a second embodiment is described with reference to FIG. 3. The structure body 6X is adopted in place of the structure body 6 in the image forming apparatus 10.

Figure 3:
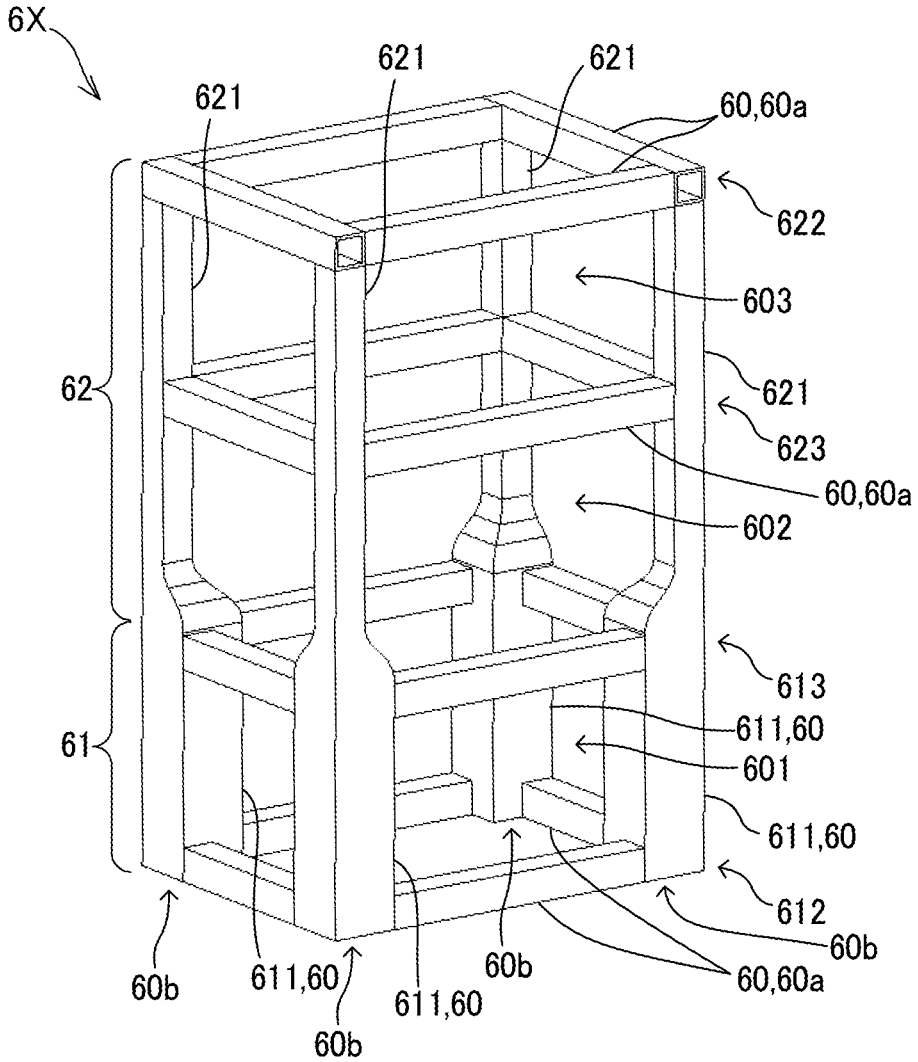
FIG. 3 is a perspective diagram of a structure body according to a second embodiment.

In FIG. 3, components that are the same as those shown in FIG. 1 and FIG. 2 are assigned the same reference signs. The following describes a difference between the structure body 6X and the structure body 6.

In the structure body 6X, each pair of the first column portion 611 and the second column portion 621 extending to each other is composed of a deformed square pipe 60*b* that has no seam in the longitudinal direction thereof. This is the difference between the structure body 6X and the structure body 6.

Each deformed square pipe 60*b* is a square pipe in which a part is thicker than the other part. A thick part of the deformed square pipe 60*b* is the first column portion 611, and the other part is the second column portions 621.

In the present embodiment, opposite end portions of each of four pipe members 60 that constitute the first partition frame portion 613 are welded to sides of the four deformed square pipes 60*b*. With this configuration, the first partition frame portion 613 and parts of the four deformed square pipes 60*b* form a rectangle.

The adoption of the structure body 6X produces the same effect as the adoption of the structure body 6.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A structure body of an image forming apparatus, the structure body storing and supporting a sheet feed portion, a print portion, and a developer container, the print portion configured to form an image on a paper sheet supplied from the sheet feed portion, the developer container configured to supply developer to the print portion, the structure body comprising:

a lower-layer portion that is composed of a plurality of square pipes and includes four first column portions, a bottom frame portion, and a first partition frame portion, the four first column portion vertically extending, the bottom frame portion welded to lower end portions of the four first column portions to form a rectangle, the first partition frame portion welded to upper end portions of the four first column portions to form a rectangle; and an upper-layer portion that is composed of a plurality of square pipes and includes four second column portions, a top frame portion, and a second partition frame portion, the four second column portions formed to continue to the lower-layer portion and vertically extend on extension lines of the four first column portions respectively, the top frame portion welded to upper end portions of the four second column portions to form a rectangle, the second partition frame portion welded to the four second column portions to form a rectangle at a position between the first partition frame portion and the top frame portion, wherein each of the first column portions is thicker than each of the second column portions, the lower-layer portion forms a first space that stores the sheet feed portion, a portion of the upper-layer portion under the second partition frame portion forms a second space that stores the print portion, and a portion of the upper-layer portion above the second partition frame portion forms a third space that stores the developer container.

2. The structure body of the image forming apparatus according to claim 1, wherein each pair of a first column portion and a second column portion extending to each other is composed of a square pipe which has no seam in a longitudinal direction thereof and in which a part is thicker than the other part.

3. The structure body of the image forming apparatus according to claim 1, wherein each of the four second column portions is composed of a square pipe which has no seam in a longitudinal direction thereof, and lower end portions of the four second column portions are welded to the first partition frame portion.

4. An image forming apparatus comprising:

a sheet feed portion;

a print portion configured to form an image on a paper sheet supplied from the sheet feed portion;

a developer container configured to supply developer to the print portion; and the structure body according to claim 1 that stores and supports the sheet feed portion, the print portion, and the developer container.

5. The image forming apparatus according to claim 4 further comprising:

an image reading unit configured to read an image from a document sheet, wherein the image reading unit is coupled with the top frame portion of the upper-layer portion.

* * * * *